US010302284B2

(12) United States Patent
Ammer

(10) Patent No.: US 10,302,284 B2
(45) Date of Patent: May 28, 2019

(54) PORTABLE ILLUMINATION DEVICE

(71) Applicant: Jarret Ammer, New Hampton, NY (US)

(72) Inventor: Jarret Ammer, New Hampton, NY (US)

( * ) Notice: Subject to any disclaimer, the term of this patent is extended or adjusted under 35 U.S.C. 154(b) by 389 days.

(21) Appl. No.: 14/535,449

(22) Filed: Nov. 7, 2014

(65) Prior Publication Data

US 2016/0131345 A1 May 12, 2016

(51) Int. Cl.

| | |
|---|---|
| ***F21V 21/088*** | (2006.01) |
| ***F21L 4/02*** | (2006.01) |
| *F21W 131/30* | (2006.01) |
| *F21Y 115/10* | (2016.01) |

(52) U.S. Cl.

CPC ..... *F21V 21/0885* (2013.01); *F21L 4/027* (2013.01); *F21W 2131/30* (2013.01); *F21Y 2115/10* (2016.08)

(58) Field of Classification Search

CPC ..... F21W 2131/30; F21W 2131/10; F21Y 2101/00; F21L 4/027; F21V 21/088; F21V 21/0885

USPC ..... 362/183, 396

See application file for complete search history.

(56) References Cited

U.S. PATENT DOCUMENTS

| | | | | |
|---|---|---|---|---|
| 7,300,172 | B1 * | 11/2007 | Lefler | A47L 9/2836 362/191 |
| 7,736,008 | B2 | 6/2010 | Quattrini, Jr. | |
| 8,240,893 | B2 * | 8/2012 | Lin | F21L 4/04 362/118 |
| 8,387,939 | B2 * | 3/2013 | Ford | B62J 6/02 224/418 |
| 2005/0160553 | A1 | 7/2005 | Gregory | |
| 2006/0215390 | A1 | 9/2006 | Jones et al. | |
| 2006/0215391 | A1 | 9/2006 | Jones et al. | |
| 2009/0059569 | A1 | 3/2009 | Quattrini, Jr. | |
| 2011/0157874 | A1 * | 6/2011 | Sant | F21L 14/00 362/106 |

FOREIGN PATENT DOCUMENTS

| | | |
|---|---|---|
| CN | 2843330 | 12/2006 |
| CN | 101467857 | 7/2009 |
| CN | 201379515 | 1/2010 |
| CN | 201469208 | 5/2010 |
| CN | 101779939 | 7/2010 |

(Continued)

*Primary Examiner* — Diane I Lee
*Assistant Examiner* — Naomi M Wolford
(74) *Attorney, Agent, or Firm* — Joshua Kaplan; Kaplan Law Practice, LLC

(57) ABSTRACT

The present disclosure teaches and describes an illumination device that may be coupled to a variety of objects to help provide lighting to an area. The illumination device has at least two sections that are connected by a hinge and rotate around that hinge. The illumination device further has adapters to increase the grip and hold of the device. The device may be lockable or use tension to hold it in a particular configuration. The illumination device has a number of light emitting diodes placed on the various surfaces of the device. The light emitting diodes provide lighting to assist individuals in performing tasks in dark or poorly lit areas. The lighting is controlled by a power switch which may also change the intensity of the light.

17 Claims, 4 Drawing Sheets

(56) References Cited

FOREIGN PATENT DOCUMENTS

| | | |
|---|---|---|
| CN | 201591529 | 9/2010 |
| CN | 201710290 | 1/2011 |
| CN | 201790754 | 4/2011 |
| CN | 102048504 | 5/2011 |
| CN | 102100513 | 6/2011 |
| CN | 202051661 | 11/2011 |
| CN | 202122549 | 1/2012 |
| CN | 202235188 | 5/2012 |
| CN | 202262950 | 6/2012 |
| CN | 202269984 | 6/2012 |
| CN | 202288164 | 7/2012 |
| CN | 202313146 | 7/2012 |
| KR | 864187 | 10/2008 |
| WO | 2002037959 | 5/2002 |

* cited by examiner

105

105

115

PORTABLE ILLUMINATION DEVICE

CLAIM OF PRIORITY

This application is a non-provisional application and claims no priority to any patent or patent application.

FIELD OF THE INVENTION

The field of the invention relates to an illumination device, namely a device that provides hands free illumination to an area. In particular, the field of the present invention relates to an illumination device that attaches to a secondary object illuminating a space enabling work to be performed.

BACKGROUND OF THE INVENTION

Light, namely visible light is responsible for facilitating human sight. Visible light is vitally important for human survival yet is only present in a narrow band of the electromagnetic spectrum, existing in wavelengths from about 380 nanometers to about 750 nanometers. The remaining electromagnetic spectrum comprises various forms of radiation (non-visible light) including gamma radiation, X-ray radiation, ultraviolet radiation, infrared radiation, terahertz radiation, microwave radiation, and radio waves.

The advent of modern technology has increased the number of mechanisms and manner in which such visible light, and various other types of light including ultraviolet and infrared, are created as well as harnessed. Many forms of artificial light are stationary in that they are tied to fixtures such as lighting in homes. The capability of having portable light, such as a flashlight, aids to illuminate areas where there is minimal lighting. This increases the visibility for the user when maneuvering in these areas and/or locating certain items where there is limited or minimal lighting.

The need to provide lighting to specific areas in a convenient fashion is a continual challenge for those in society. Often, such lighting requirements may be necessary for a particular occupation such as a plumber or electrician or may be used for recreational purposes such as hiking or spelunking.

Many lighting options are designed to provide a particular purpose (i.e. a flashlight). These items are designed with that purpose whether it be illuminating a specific area or a general area and have limited flexibility in how they are used. Thus, there is a need for a lighting, or illumination, device that has a wide range of flexibility in terms of its used with differing objects and the situations in which it can be used. Additionally, such a device should be readily portable and lightweight so that it does not interfere with the overarching task at hand.

REVIEW OF RELATED TECHNOLOGY

U.S. Patent Application 2009/0059569 pertains to a push cleaning tool comprising a light source that is designed to illuminate a floor or other flat work surface in front or behind the tool for the purpose of locating and collecting small hard to see objects. This can be for the purpose of cleaning or simply locating a small valuable object. The light source is fashioned such that it provides a very low grazing angle of illumination that it skims across a surface. Small objects or particles are visible as being brighter than the surroundings and set off by a long shadow on the side of the particle away from the light.

U.S. Patent Application 2006/0215391 pertains to a handheld implement, such as a brush, detailer, applicator, or the like, including a housing and a work element connected to the handle. The implement also includes a light, a power source connected to the light, and a switch for turning on and off the power source for illuminating the light. The work element is concealable in the housing when the implement is not in use, and can be extendable from the housing when the implement is in use. The light, via switching the light on or off, selectively illuminates a surface on which the work element of the implement is employed or operates. The work element is, for example, bristles, and the light is a low power bulb or LED.

U.S. Patent Application 2006/0215390 pertains to an implement, such as a broom or mop for cleaning, including a handle and a cleaning feature connected to the handle. The implement also includes a light connected to the implement, a power source of the implement connected to the light, and a switch of the implement for turning on and off the power source for illuminating the light. The power source is, for example, a battery. The power source, switch and light are electrically connected internally within the implement, and the switch is exposed for manual switching and the light is exposed for illuminating an area serviced by the implement. Alternately, the switch is automatically triggered by a servicing occurrence.

Korean Patent 864,187 pertains to a luminous broom including a handle rod, a radiation unit for emitting a light by a user's selection by being connected to the handle rod, and a brush of which one end receives the light emitted from the radiation unit by being fixed to be adjacent to the radiation unit, and the other end comprises plural optical fiber for emitting the light by being exposed to the outside.

Various devices are known in the art. However, their structure and means of operation are substantially different from the present disclosure. These devices are either permanently attached or have limited functionality. The other inventions fail to solve all the problems taught by the present disclosure. The present disclosure provides for an illumination device that can couple to a variety of objects and have a number of differing functions. At least one embodiment of this invention is presented in the drawings below and will be described in more detail herein.

SUMMARY OF THE INVENTION

The present disclosure describes and teaches an illumination device having a first section with a first upper surface, a first bottom surface, and a first side surface; a second section having a second upper surface, a second bottom surface, and a second side surface, wherein the first section and the second section are rotatably coupled; a plurality of lighting mechanisms disposed along the surfaces of the first section and the second section; and at least one adapter disposed on the first side surface and the second side surface. The illumination device may further have a power source such as a battery or solar cell. The battery may be rechargeable or non-rechargeable.

The illumination device further has a power switch which may be slidable or depressible or some combination thereof. The power switch is used to change the operative state of the lighting mechanism. Further, the power switch may also be able to change the intensity of the lighting mechanism. The aforementioned lighting mechanism is preferably a plurality of light emitting diodes. The light emitting diodes may be arranged in a particular configuration to suit a particular need. Thus, the light emitting diodes may be disposed along any number or combination of the surfaces of the illumination device. Further, the illumination device may have protective measures such as a covering or ridges to protect the lighting mechanisms.

Generally, the first section and the second section are held, or coupled, together by a coupling mechanism which may be a pin, screw, nail, or the like or any combination thereof. There may be a requirement for more than one coupling mechanism. The coupling mechanism should provide for free rotation of the first section and the second section with respect to one another. The adapters are ideally located on the side surfaces and more particularly in the area which will be making contact with a secondary object. The adapters are shaped and selected from material(s) that are designed to increase grip or friction while providing maneuverability. The first and second section, when brought together, may have a locking mechanism that holds the two sections in place.

The illumination device is typically placed around generally round objects such as the handle to a broom, rake, shovel, or mop or the like. The secondary object may also not be round and the internal shape of the illumination device may reflect a particular intended usage. In some embodiments, the illumination device has a charging port that can be used to couple the illumination device to a charger that charges the power source contained therein.

In general, the present invention succeeds in conferring the following, and others not mentioned, benefits and objectives.

It is an object of the present invention to provide an illumination device that is lightweight and portable.

It is an object of the present invention to provide an illumination device that can be coupled to a variety of secondary objects.

It is an object of the present invention to provide an illumination device that provides lighting to an area with limited natural or artificial lighting.

It is an object of the present invention to provide an illumination device that is hands free.

It is an object of the present invention to provide an illumination device that provides variable intensity lighting.

It is an object of the present invention to provide an illumination device that provides for long operational duration between charging or replacement of the power source.

It is an object of the present invention to provide an illumination device that is inexpensive.

It is an object of the present invention to provide an illumination device that is durable and protects the lighting mechanism from damage.

It is an object of the present invention to provide an illumination device that provides multidirectional lighting.

BRIEF DESCRIPTION OF THE DRAWINGS

Embodiments of the present invention will now be described, by way of example only, with reference to the accompanying drawings, in which.

DETAILED DESCRIPTION OF THE DRAWINGS

Figure 1A:
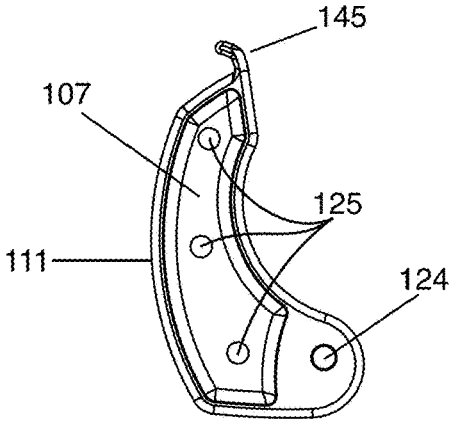
FIG. 1A is a top view of a first section of an embodiment of the present invention.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Figure 1B:
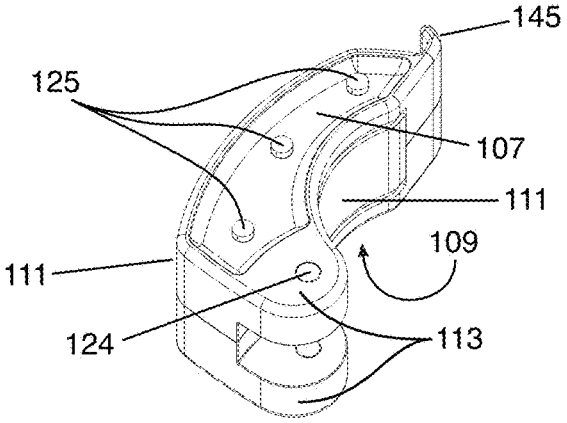
FIG. 1B is a perspective view of a first section of an embodiment of the present invention.

Referring to FIGS. 1A and 1B, there is a first section 105 of the illumination device 100. The first section 105 has a first upper section 107, a first side surface 111, and a first bottom surface 109. Additionally, there is a first connecting section 113. The main portion of the first section 105 is substantially semi-circular with a protruding connecting section 113. The connecting section 113 has an upper and lower section with a space therebetween. Through each of the upper and lower section of the connecting section 113 there is an aperture 124 extending therethrough. The aperture 124 in each of the upper and lower section should align with one another. Opposite the connecting section 113 there is a flared locking mechanism 145.

The first upper surface 107 has at least one, and preferably at least three, lighting mechanisms 125. The lighting mechanisms 125 may be embedded within the first upper surface 107 or they may be protruding from the first upper surface 107. In some cases, the lighting mechanism 125 may be disposed on the first side surface 111 or the first bottom surface 109 either singularly or in conjunction with the first upper surface 107.

Figure 2A:
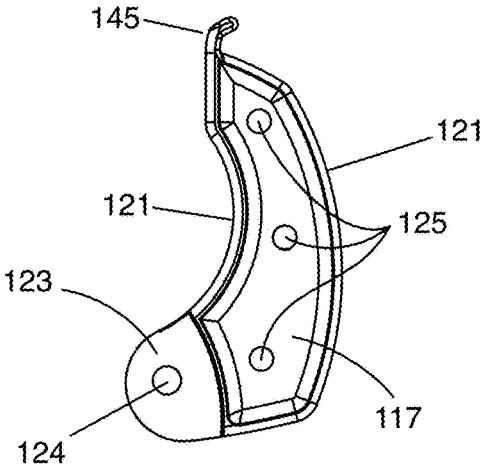
FIG. 2A is a top view of a second section of an embodiment of the present invention.
Figure 2B:
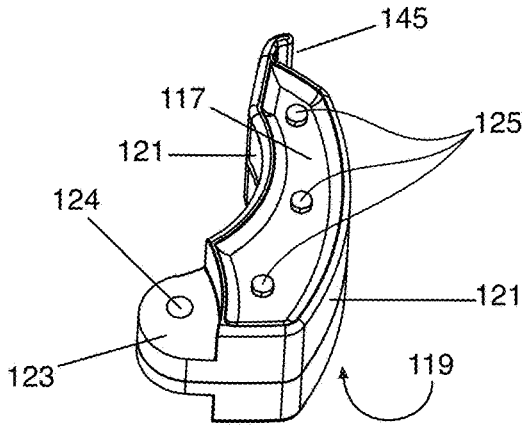
FIG. 2B is a perspective view of a second section of an embodiment of the present invention.

The second section 115 is shown in FIGS. 2A and 2B. The second section 115 generally mirrors the first section 105. The second section 115 has a second upper surface 117, a second bottom surface 119, and a second side surface 121. The second connecting section 123 only has one protruding surface which fits in the space between the upper section and the lower section of the first connecting section 113. The aperture 124 aligns with the apertures 124 in the upper and lower section of the first connecting section 113. When the apertures 124 are properly aligned a connecting mechanism 129 can be positioned to extend therethrough (see FIG. 3). The connecting mechanism 129 may be permanently positioned using caps, adhesives, welds, and the like or some combination thereof.

Figure 3:
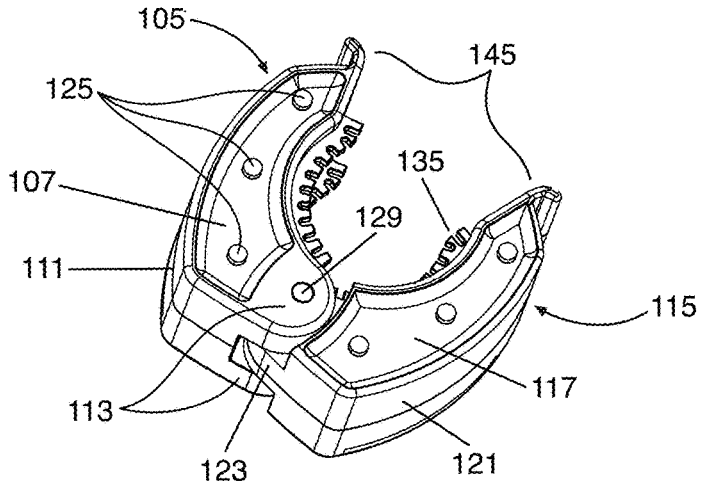
FIG. 3 is a perspective view of an embodiment of the present invention in an open position.

In FIG. 3, there is an assembled illumination device 100. The assembled illumination device 100 primarily comprises a first section 105, a second section 115, a plurality of lighting mechanism 125, a coupling mechanism 129, and a locking mechanism 145. On a portion of the first side surface 111 and the second side surface 121, there is at least one adapter 135 disposed thereon. The adapter 135 is shaped to flexibly fit the interior side surface to which it is disposed. The adapters 135 have grooves 137 that assist in the illumination device 100 providing friction, or grip, to enable it to be positioned along or on a secondary object.

Similar to the configuration of the surfaces of the connecting sections 113, 123 the adapters 135 are interspaced in much of the same fashion. Either the first section 105 or the second section 115 preferably has two adapters 135, whereas the other section preferably has one adapter 135. The section with the two adapters 135 are spaced in a way that the sole adapter 135 on the other section fits between the two adapters 135 when the sections are brought together. The adapters 135 may be adhered to the sections with an adhesive or may be an extension of the sections themselves.

The lighting mechanisms 125 shown here are light emitting diodes or LEDs. The LEDs may be spaced and oriented in a way as to provide the greatest luminance without obstructing the vision of the user. Preferably there are at least three (3) LEDs per section and the LEDs may be placed on the upper surface, side surface, or bottom surface. The LEDs are powered by a power source (see FIG. 5). The power source is preferably a battery which may be rechargeable or non-rechargeable.

Figure 4:
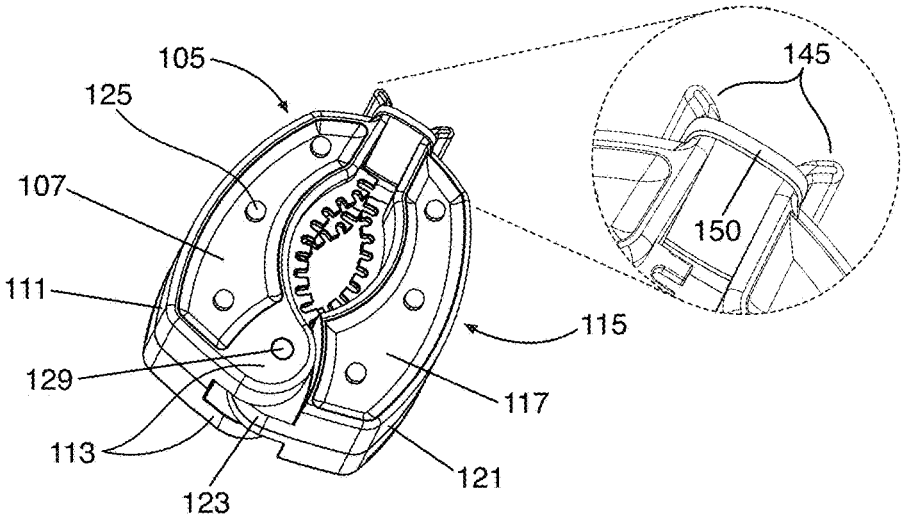
FIG. 4 is a perspective view of an embodiment of the present invention in a closed position.

Further, the locking mechanism 145 may be used to temporarily or permanently adhere the illumination device 100 to a secondary object Each of the first section 105 and the second section 115 has a flared locking mechanism 145 on an end opposite the connecting section 113, 123. Once brought together (as close as the secondary object will permit) a band 150 may be placed around the locking mechanism 145 and the flared ends prevent the band 150 from slipping off during use. This band 150 and closed configuration is present in FIG. 4.

Figure 5:
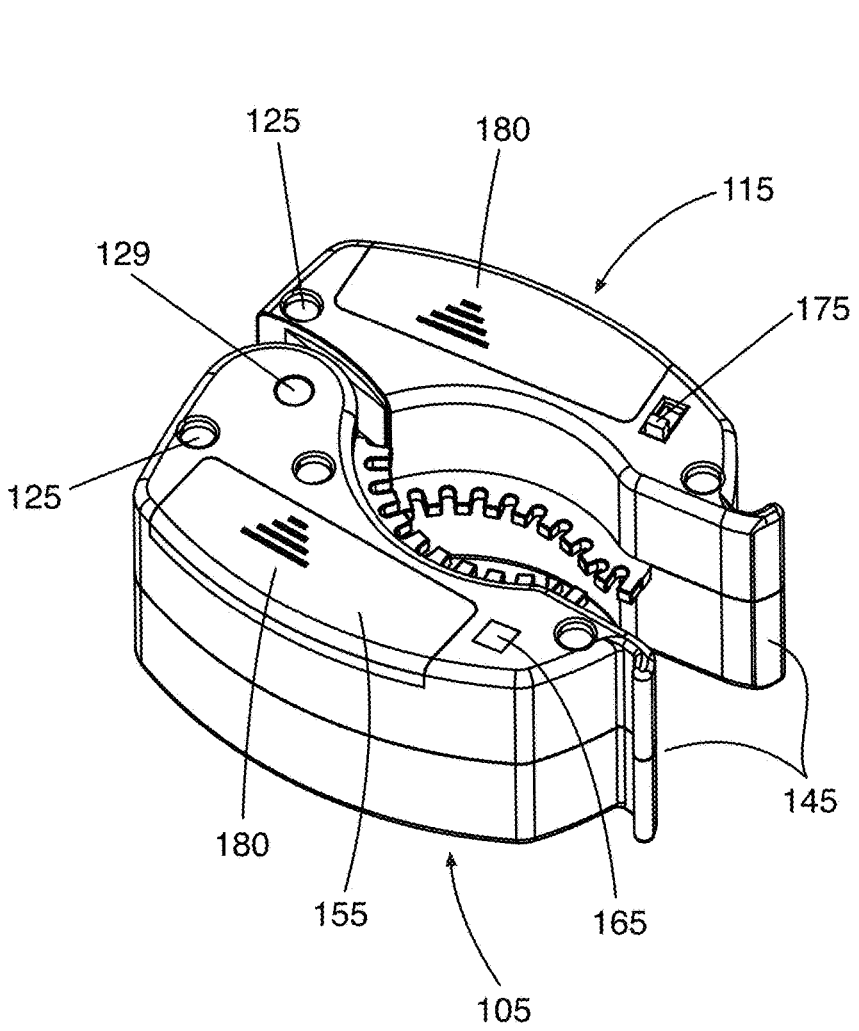
FIG. 5 is a perspective bottom view of an embodiment the present invention.

In FIG. 5, there is a bottom view of the illumination device 100. The illumination device 100 has much of the same structure as does the top surface (see FIG. 3). There are a number of lighting mechanisms 125 across the bottom surface. There is also the connecting mechanism 129 which extends through the two sections of the invention. The bottom of the illumination device 100 also has a battery compartment 180 which the power source 155, preferably batteries, reside therein. The battery compartment 180 has a removable case. There may be more than one battery compartment 180 as shown. The bottom also harbors the power switch 165. The power switch 165 changes the operative state of the lightening mechanisms 125 and may also function to vary the intensity of light emanating from the lighting mechanisms 125. A charging port 175 enables the power source 155 to be recharged. The charging port 175 may be able to receive a number of different connectors including various universal serial bus connectors, plugs, and the like.

Figure 6:
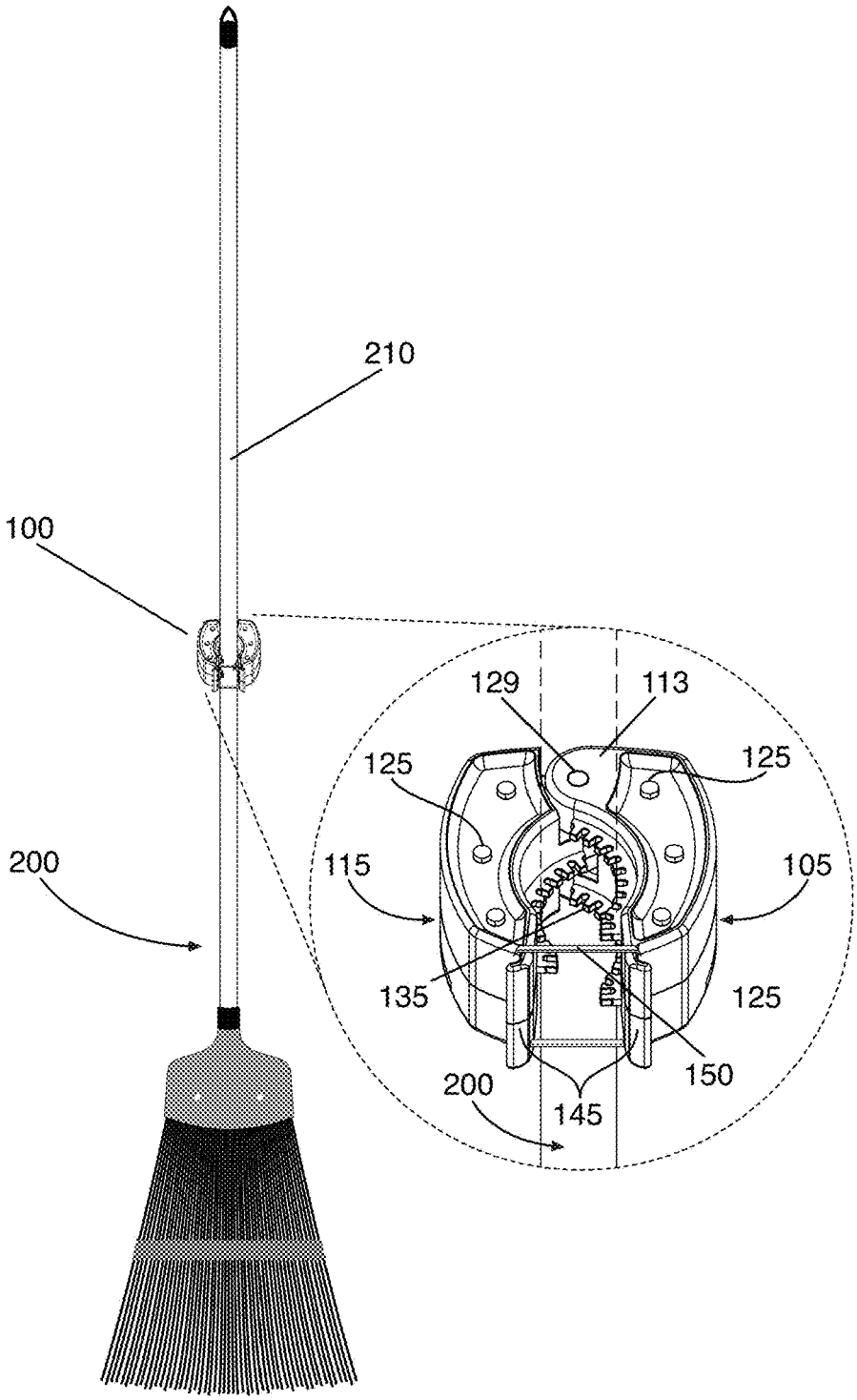
FIG. 6 is illustrates one of the intended usages in accordance with the present invention.

FIG. 6 shows the illumination device 100 being used in at least one manner as intended. The illumination device 100 is attached to a secondary device, in this case, a broom 200. More specifically, the illumination device 100 is attached to a broom handle 210. The broom handle 210 passes through the aperture formed when the two sections of the illumination device 100 are brought together encircling the broom handle 210. The illumination device 100 is secured by placing the band 150 around the flared locking mechanism 145. The band 150 is preferably a rubber or silicone based band that has a certain degree of flex and rigidity to it. Thus, the band 150 can be readily stretched and fit over the locking mechanism 145, but will not have so much give as to permit the illumination device 100 to come loose during use.

The adapters 135 provide the physical contact between the illumination device 100 and the broom handle 210. The adapters 135 have grooves 137 which aids in the adapter being able to flex and grip the broom handle 210. Preferably, the adapters 135 are a rubber or have a non slip coating that prevents undesirable movement of the adapter 135 and, in turn, the illumination device 100 when being used. Once in the "on" configuration, the lighting mechanisms 125 produce artificial light that can be used in limiting light situations.

Additionally, the lighting mechanism 125 may have variable lighting intensities that can be used as necessary in a multitude of lighting conditions. Thus, you may be able to better see behind a larger piece of furniture that would be difficult to move, which then enables you to clean behind it better. Additionally, if you are working in a dimly lit basement, the illumination device 100 can provide light while you use your tools, such as a screwdriver, without having to hold a light. The light emanating from the illumination device 100 may be able to be focused on a particular area.

Generally, the main structure of the illumination device 100 including the first section 105, second section 115 comprise plastics, such as but not limited to, polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof. Further the illumination device may comprise composites, including but are not limited to, fiber reinforced plastics, metal composites, carbon fiber, and Kevlar® and the like. Metals used in the illumination device 100 may comprise lightweight metals such as aluminum and other pure metals as well as various alloys. The materials should be chosen for their lightweight, yet durable, properties.

The adapters 135 are preferably primarily comprised of a rubber such as natural rubber, styrene-butadiene rubber (SBR), Isoprene rubber, Butadiene rubber, or (poly)chloroprene rubber or some combination thereof. The lighting mechanism 125 may be light emitting diodes (LEDs) or organic light emitting diodes (OLEDs) or a combination thereof. Other lighting elements can be used to create a similar effect. Any color of lighting can be selected to be used in conjunction with the present invention, and in some cases the illumination device may be capable of producing multiple colors of light.

What is claimed is:

1. An illumination device comprising:

a first section having a first upper surface, a first bottom surface, and a first side surface;

a second section having a second upper surface, a second bottom surface, and a second side surface, wherein the first section and the second section are rotatably coupled;

a locking mechanism, wherein the locking mechanism comprises a first flared portion on the first section, a second flared portion on the second section, and a band configured to couple the first flared portion and the second flared portion;

a plurality of lighting mechanisms disposed on the first section and the second section; and a first adapter disposed on an inner portion of the first side surface and a second adapter disposed an inner portion of the second side surface, wherein the first adapter has two engaging portions and the second adapter has one engaging portion, wherein the two engaging portions are separated by a distance and the one engaging portion is configured to reside in the distance when the first section and the second section are brought together.

2. The illumination device of claim 1 further comprising a power source.

3. The illumination device of claim 1 further comprising a power switch.

4. The illumination device of claim 3 wherein the power switch is configured to modify an operative state of the plurality of lighting mechanisms.

5. The illumination device of claim 4 wherein the plurality of lighting mechanisms are light emitting diodes.

6. The illumination device of claim 1 further comprising a plurality of lighting mechanisms disposed along the first bottom surface and the second bottom surface.

7. The illumination device of claim 1 wherein the first section and the second section are coupled with a pin, screw, nail or any combination thereof.

8. An illumination device comprising:

a first section having a first upper surface, a first bottom surface, a first side surface, and a first connecting section;

a second section having a second upper surface, a second bottom surface, a second side surface and a second connecting section, wherein each of the first and the second connecting sections have an aperture extending therethrough for receiving a coupling mechanism, and wherein the first section and the second section are rotatably coupled by way of the coupling mechanism;

a locking mechanism, wherein the locking mechanism comprises a first flared portion on a terminal end of the first section, a second flared portion on a terminal end of the second section, and a band configured to couple the first flared portion and the second flared portion, and wherein the first flared portion and the second flared portion are flared in opposing directions from one another;

a plurality of light emitting diodes disposed in a singular recess along each of the first upper surface and the second upper surface, wherein there are at least two light emitting diodes disposed in each recess;

a first adapter disposed along an inner portion of the first side section and a second adapter disposed along an inner portion of the second side section, wherein the first adapter has two engaging portions comprising a series of grooves and the second adapter has one engaging portion comprising a series of grooves, and wherein the two engaging portions are separated by a distance and the one engaging portion is configured to reside in the distance when the first section and the second section are brought together;

a power source configured to provide power to the plurality of light emitting diodes; and a power switch configured to modify an operative state of the plurality of light emitting diodes.

9. The illumination device of claim 8 further comprising a charging port in either the first section or the second section.

10. The illumination device of claim 8 wherein the power source is a rechargeable or non-rechargeable battery.

11. The illumination device of claim 8 wherein the adapters are comprised of a texturized rubber.

12. The illumination device of claim 8 wherein the connection mechanism is a pin, screw, nail, or any combination thereof.

13. The illumination device of claim 8 wherein the illumination device is coupled to a secondary object.

14. The illumination device of claim 13 wherein the secondary object is a mop, brush, rake, shovel, broom, or push cleaner.

15. The illumination device of claim 13 wherein the adapters frictionably engage the secondary object.

16. The illumination device of claim 8 wherein there are at least three light emitting diodes per section.

17. The illumination device of claim 8 further comprising a protective ridge disposed along each recess of the first and the second sections, wherein the protective ridge limits or prevents contact with the light emitting diodes.

* * * * *